US005653023A

United States Patent [19]

Andina

[11] Patent Number: 5,653,023

[45] Date of Patent: Aug. 5, 1997

[54] CUTTING DEVICE FOR REMOVING THE UPPER PART OF PLASTIC OR METAL ALLOY CAPSULES COVERING THE CORK IN BOTTLES OF WINE AND THE LIKE

[75] Inventor: Diego Andina, Lumezzane, Italy

[73] Assignees: Ghidini Cipriano S.a.s.; di Diego Andina and C., both of Lumezzane, Italy

[21] Appl. No.: 650,679

[22] Filed: May 20, 1996

[30] Foreign Application Priority Data

May 24, 1995 [IT] Italy ..... MI95U0350

[51] Int. Cl.[6] ..... B67B 7/46

[52] U.S. Cl. ..... 30/1.5; 7/156; 81/3.07

[58] Field of Search ..... 30/1.5, 2, 94, 101, 30/102, 280, 400; 81/3.07, 3.09, 3.29; 7/151, 156

[56] References Cited

U.S. PATENT DOCUMENTS

D. 142,202 8/1945 Lanyon ..... 30/1.5

4,723,465 2/1988 Hughes ..... 81/3.09

4,845,844 7/1989 Allen ..... 30/1.5

5,372,054 12/1994 Federighi, Sr. ..... 7/156

*Primary Examiner*—Hwei-Siu Payer

*Attorney, Agent, or Firm*—Guido Modiano; Albert Josif

[57] ABSTRACT

A cutting device for removing the upper part of capsules covering the cork in bottles of wine and the like, including a body made of rigid plastics that is substantially shaped externally like a parallelepiped and substantially has the profile of a stylized uppercase U, the internal opposite faces of the wings of said U having two opposite and identical step-like recesses, on each whereof two raised portions or teeth are provided which support, in a recessed position with respect to the inner edge of the wings, a sharp metal cutting blade that is substantially curved in a semicircular shape so as to allow the mutually opposite and co-planar blades to form, therebetween, the space for insertion on the capsule that is anchored to the bottle neck, thinner regions being furthermore provided on the wings that support the laminae and being adapted to make the wings flexible, so as to allow to clamp them on the capsule and cut the upper part of the capsule by a rotation of the wings through approximately 180° around the neck of the bottle.

6 Claims, 2 Drawing Sheets

CUTTING DEVICE FOR REMOVING THE UPPER PART OF PLASTIC OR METAL ALLOY CAPSULES COVERING THE CORK IN BOTTLES OF WINE AND THE LIKE

BACKGROUND OF THE INVENTION

The present invention relates to a manually-operated cutting device for removing the upper part of plastic or metal alloy capsules or caps, generally provided to protect the cork for closing bottles of wine and the like, before removing the cork by using conventional corkscrews.

It is well-known that in vineyards the upper part of the neck of bottles of wine, usually rather fine wine, is usually covered with capsules or caps made of plastics or metal alloy after the cork has been inserted in the neck. These capsules in practice protect the cork from atmospheric agents as well as the wine from alterations caused by the porosity of the corks, which may not ensure perfect tightness to the passage of air which, as known, would cause undesirable alterations in the organoleptic properties of the wine.

It is also well-known that removal of the protective capsules from the neck of the bottles before removing the cork often entails difficulties in execution: in some cases, as for example in a home environment, the capsule is in fact not removed but torn in an irregular fashion by the screw-shaped stem of the corkscrew as it is inserted fully into the cork.

This operation entails the drawback of making cork extraction more difficult and of forming, after extraction, frayed or untidily cut capsule parts that must be removed manually and with difficulty in order to correctly pour the wine or liquor.

In other cases, in order to remove at least the flat part of the capsule covering the cork, various cutting devices are used in addition to normal knives, which are difficult to use, and allow to correctly cut the upper part of the capsule without excessive efforts and quickly.

Thus, for example, rigid twin-blade cutters are known that can be opened out in a scissorlike fashion but entail, at the beginning and during cutting, difficulties in positioning and guiding the blades on the bottle neck, considerable efforts to keep the two blades closed, and a rotary motion of the blades around the neck that always covers more than 180° and sometimes more than 360°.

Other cutting devices are also known which are constituted by a rectangular metallic lamina folded in a U-like shape and supporting, at the ends of its two wings, two sharp laminae or wheels that face each other on the same plane and allow to cut the upper part of the capsule by clamping the two wings and turning them through more than 180° around the bottle neck; in other cases, the U-shaped lamina supports, at its ends, two curved blades with a sharp cutting edge that are opposite and co-planar with respect to each other and allow to cut the capsule with a 180° rotation.

In practice, these known capsule cutting devices require the use of U-shaped steel blades the dimensions whereof are chosen so as to be thin and have longitudinal sharp edges; accordingly, in addition to being scarcely elegant, they are also scarcely practical due to the difficulty in keeping two thin wings stable between the fingers of one's hand during rotation for cutting, Said cutting devices, which are entirely made of metal, furthermore require rather high production costs.

SUMMARY OF THE INVENTION

The aim of the present invention is therefore to provide a cutting device for removing the upper part of the plastic or metal capsule normally covering the cork of bottles of wine and liquors, which is conceived and structured so as to obviate the drawbacks of conventional devices and most of all so as to be easy and safe to use.

An object of the invention is to provide a cutting device of the above-specified type that is structured so that it is very light and reliable over time in addition to having a competitive cost and being aesthetically pleasant.

This aim, this object, and others which will become apparent from the following description are achieved by a cutting device for removing the upper part of plastic or metal capsules covering the cork in bottles of wine and liquors, which is constituted, according to the present invention, by a body made of rigid plastics that is substantially shaped externally like a parallelepiped and substantially has the profile of a stylized uppercase U, the internal opposite faces of the wings of said U having two opposite and identical step-like recesses, on each whereof two raised portions or teeth are provided which support, in a recessed position with respect to the inner edge of the wings, a sharp metal cutting blade that is substantially curved in a semicircular shape so as to allow said mutually opposite and co-planar blades to form, therebetween, the space for insertion on the capsule that is anchored to the bottle neck, thinner regions being furthermore provided on said wings that support said laminae and being adapted to make said wings flexible to allow to clamp them on the capsule and to cut the upper part of said capsule by means of a rotation of the wings through approximately 180° around the bottle neck.

More particularly, said thinner regions of the wings are formed by substantially parallel notches that are close to each other and formed in the regions of the two wings that are closest to the curved region of the U-shaped body.

Furthermore, said pairs of protrusions projecting from each step-like recess are provided with such a height, with respect to the plane of the respective recess, as to allow the base plane of the recesses to rest on the top of the capsule in order to allow to correctly maintain the position of the blades during the cutting operation.

Likewise, said base planes of the recesses that support the blades are knurled or roughened so as to engage the top of the capsule during cutting and thus facilitate its separation from the top of the cork of the bottle.

BRIEF DESCRIPTION OF THE DRAWINGS

Further characteristics and advantages of the present invention will become apparent from the following detailed description, given with reference to the accompanying drawings, which are provided merely by way of example and wherein.

DESCRIPTION OF THE PREFERRED EMBODIMENTS

Figure 2:
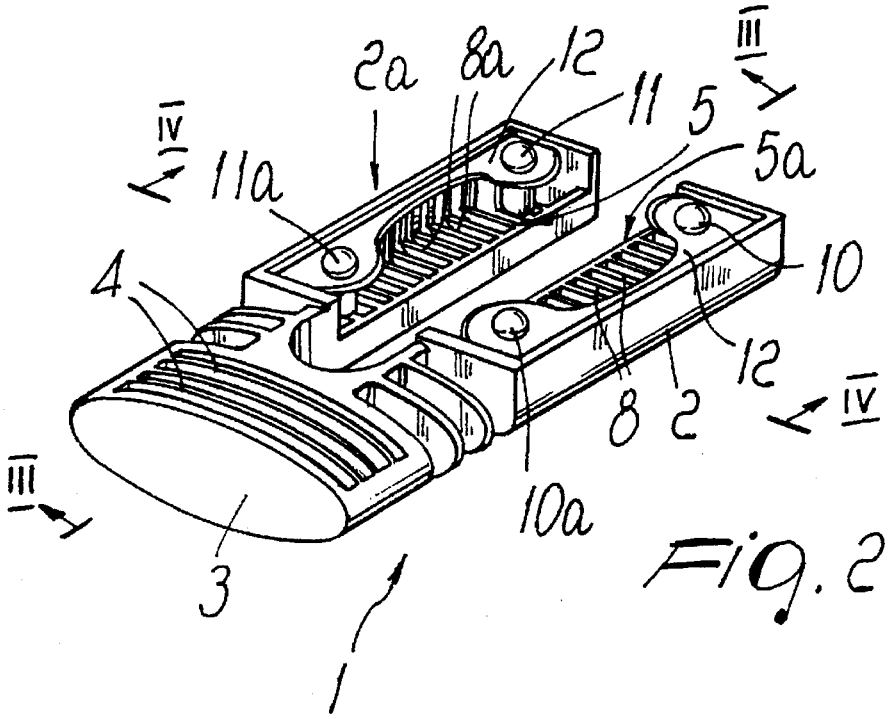
FIG. 2 is a perspective bottom view of said device of FIG. 1.
Figure 1:
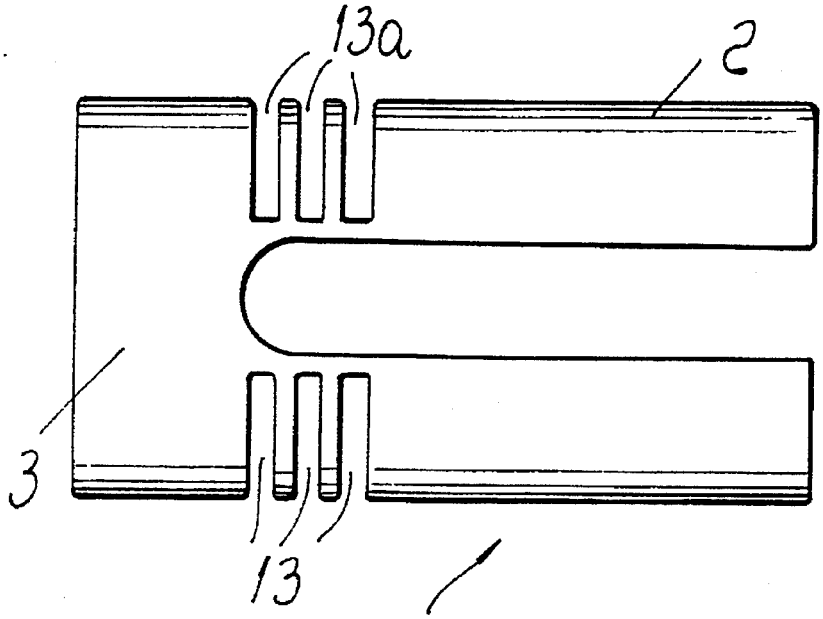
FIG. 1 is a top or plan view of the cutting device according to the invention.

With reference to the above figures, the cutting device according to the invention is substantially constituted by a body made of rigid plastics, generally designated by the reference numeral 1 in the figures, which is externally shaped substantially like a parallelepiped and has the profile of an uppercase stylized U; in other words, it is constituted by two identical straight wings 2–2*a* that are mutually parallel and connected to a block 3; lightening slots 4 are formed on one face of said block 3.

Figure 3:
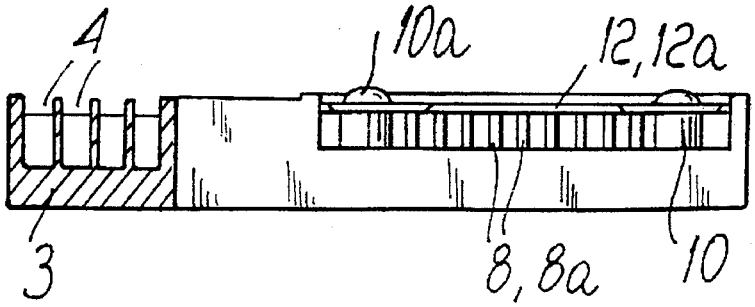
FIG. 3 is a longitudinal median sectional view, taken along the line III—III of FIG. 2.
Figure 4:
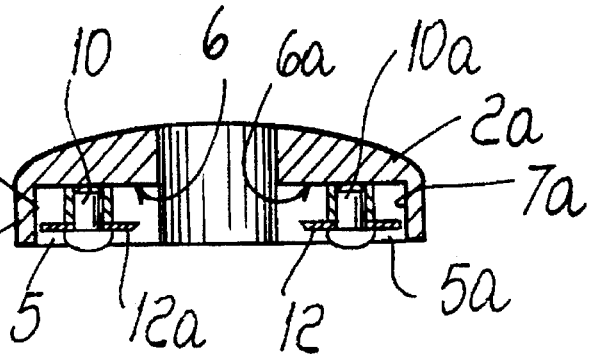
FIG. 4 is a sectional view of FIG. 2, taken along the lines IV—IV of said FIG. 2.

Two recesses 5–5*a*, substantially two mutually coplanar steps with a base plane 6–6*a*, are formed in the outer face of both wings 2–2*a*, which have a quadrangular transverse cross-section (FIG. 2). Both said bases 6–6*a* and the corresponding side walls 7–7*a* are provided with parallel sets of teeth 8–8*a* (FIGS. 2–4), the purpose whereof is to produce friction between the bases and the side walls of the recesses 5–5*a* and the upper and lateral surfaces of a plastic or metal capsule, generally designated by the reference numeral 9, during the cutting of the upper part 9*a* of said capsule.

Two mutually spaced projecting pins, designated respectively by the reference numerals 10–10*a* and 11–11*a*, are formed on each one of the two toothed bases 6–6*a;* a sharp blade is stably anchored to each one of said pairs of pins and is designated respectively by 12 and 12*a;* said blades are provided with a sharp cutting edge that is curved substantially in the shape of a circular or elliptical arc and are arranged on the same plane, as clearly shown in FIG. 2.

Figure 5:
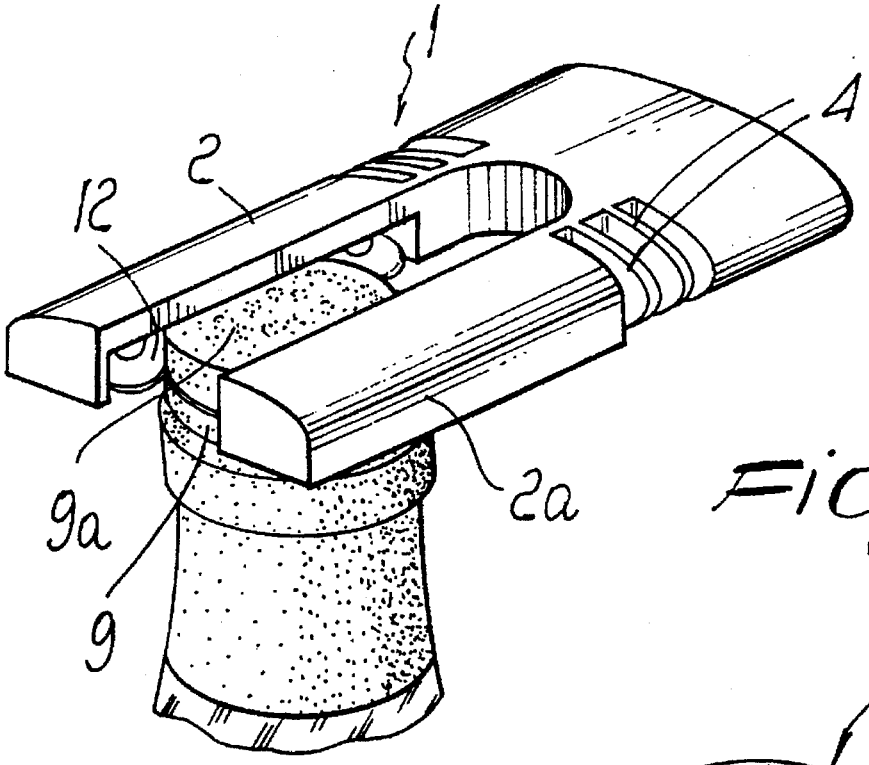
FIG. 5 is a view of the cutting device in the position for cutting the capsule that is placed on the cork of a bottle.
Figure 6:
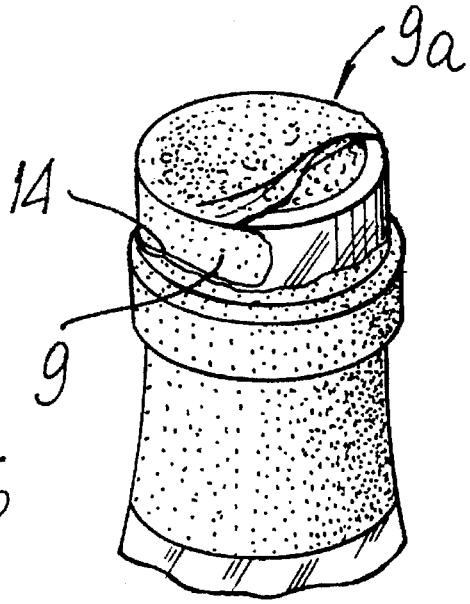
FIG. 6 is a view of the top part of the capsule after cutting by means of the device shown in FIGS. 1 and 2.

Finally, parallel slots 13–13*a* are formed between the wings 2–2*a* and the prism-shaped head 3 and constitute lightenings allowing the wings to be flexible with respect to the head 3. This flexibility allows the user to move the wings mutually closer so as to place the sharp blades in contact (on two opposite sides) with the capsule to be cut. In fact, in order to remove the upper part 9*a* of a capsule 9 (FIG. 6) it is sufficient to place the two wings 2–2*a* so that they straddle the capsule, with their blades directed towards the bottle (FIG. 5), then rest the two bases 5–5*a* on the upper flat part of the capsule, clamp the two wings, and turn the device thus positioned through approximately 180°. The rotation produces a uniform cut 14 just below the rim of the bottle, without causing fraying on the edge of the capsule left on the neck of said bottle.

Once cutting has been performed, the wings return elastically to the open parallel position, without the aid of spring-operated return means.

The particular structural simplicity of the abovedescribed device and the advantage of using plastic material instead of curved metallic laminae allow to obtain a cutting device for capsules that is very light, easy to use, safely reliable, as well as pleasant and distinctive in its appearance.

Of course, in its practical embodiment the invention as described and illustrated above can be modified, in terms of the plastic materials used, its dimensions and colors, without abandoning the scope of its protection.

What is claimed is:

1. A cutting device for removing an upper part of a capsule covering cork in a bottle of wine comprising:

a rigid plastic U-shaped body;

said body having two wings;

said wings each having an internal face facing each other;

two recesses facing each other and each formed on a respective one of said internal faces;

said recesses each having two raised portions;

semicircular-shaped metal cutting blades each supported by a respective one of said raised portions;

two of said cutting blades being mutually opposite to and co-planar with the other of said cutting blades; and thinner regions being provided on said wings for making the wings flexible;

whereby said flexible wings allow clamping of a capsule therebetween, and the cutting blades cut the upper part of the capsule when the wings are rotated around the neck of the bottle through approximately 180°.

2. A cutting device as claimed in claim 1, wherein said thinner regions of the wings are formed by parallel notches or slots arranged close to each other and formed in portions of the wings which are closest to the curved region of the U-shaped body.

3. A cutting device as claimed in claim 1, wherein said two raised portions protruding from each one of said recesses are provided with such a height as to allow said recesses to rest on the top of the capsule to be cut, so as to allow correct positioning of the blades during cutting.

4. A cutting device according to claim 3, wherein said recesses are provided, at the bottom and side walls thereof, with teeth adapted to facilitate engagement between the capsule and the side walls of the recesses while cutting the upper part of the capsule.

5. A cutting device according to claim 3, wherein said recesses are provided, at the bottom and side walls thereof, with knurlings adapted to facilitate engagement between the capsule and the side walls of the recesses while cutting the upper part of the capsule.

6. A cutting device according to claim 1, further comprising parallel lightening slots formed in the curved region of the U-shaped body.

* * * * *